United States Patent [19]

Chang

[11] 4,314,013

[45] Feb. 2, 1982

[54] PARTICLE FORMATION BY DOUBLE ENCAPSULATION

[75] Inventor: Yew C. Chang, Oakville, Canada

[73] Assignee: Xerox Corporation, Stamford, Conn.

[21] Appl. No.: 27,176

[22] Filed: Apr. 4, 1979

[51] Int. Cl.[3] ..... G03G 17/04; 204 181;32

[52] U.S. Cl. ..... 430/37; 430/32; 430/901; 106/288 Q; 106/308 M

[58] Field of Search ..... 252/62.1 P; 430/37, 430/45, 111, 901

[56] References Cited

U.S. PATENT DOCUMENTS

| | | | |
|---|---|---|---|
| 2,940,847 | 6/1960 | Kaprelian | 96/1 PE |
| 3,383,993 | 5/1968 | Yeh | 96/1 PE |
| 3,384,488 | 5/1968 | Tulagin et al. | 96/1 PE |
| 3,384,565 | 5/1968 | Tulagin et al. | 204/181 |
| 3,890,240 | 6/1975 | Hochberg | 252/62.1 P |
| 3,954,640 | 5/1976 | Lu et al. | 252/62.1 P |
| 4,032,339 | 6/1977 | Grushkin et al. | 96/1 PE |

FOREIGN PATENT DOCUMENTS

| | | | |
|---|---|---|---|
| 939953 | 1/1974 | Canada | 96/1 PE |
| 1210071 | 10/1970 | United Kingdom | 430/901 |

*Primary Examiner*—Richard L. Schilling
*Assistant Examiner*—John L. Goodrow

[57] ABSTRACT

An improved photoelectrophorectic imaging process which comprises placing a suspension of double encapsulated electrically photosensitive particles in an electric field between a pair of surfaces, exposing the suspension to a pattern of electrogmagnetic radiation and separating the surfaces whereby the exposed portion of the suspension adheres to one surface and the unexposed portion adheres to the other surface. The imaging particles are comprised of a first resin which encapsulates a colorant for the particle and second resin which encapsulates the first resin and contains the electrically photosensitive material.

11 Claims, 1 Drawing Figure

PARTICLE FORMATION BY DOUBLE ENCAPSULATION

PRIOR ART STATEMENT

This invention relates to a photoelectropheretic imaging process and more particularly to a novel particle utilized in such process.

The photoelectrophoretic imaging process is well known and is typically described in U.S. Pat. Nos. 3,384,565 and 3,384,488 to Tulagin et al. These patents disclose an imaging process and materials used therein whereby an electrically photosensitive particle absorbs light and exchanges charge while under a high electrical field. According to this process, selectively colored pigments, usually the three subtractive primary colored pigments are combined in an electrically insulating liquid so as to provide a black colored imaging suspension. The three differently colored pigments must be combined carefully so as to produce a black color by absorption of all wavelengths while at the same time the varying photographic speeds of each pigment must be taken into consideration.

Because the photoelectrophoretic imaging process is highly sensitive and utilizes simple mechanical means for producing images, it lends itself to apparatus which can quickly reproduce line copy desirably in black print.

One attempt to achieve a simple black particle useful in the photoelectrophoretic imaging process is described in Canadian Pat. No. 939,953 to Hwa et al. This patent describes a photoelectrophoretic imaging method utilizing a particle comprising non-photosensitive black colored material having a relatively small amount of electrically photosensitive material attached therein a resinous material. While the patent describes generally a method of attaching the electrically photosensitive material to the resin by means of heat and agitation, all of the examples and the preferred embodiment utilize a solvent, such as a methylene chloride, to soften the resin so that the electrically photosensitive material adheres to the softened resin. One source of resinous material containing carbon black is typically xerographic toner found in the prior art. While no specific type of carbon black is specified in the above mentioned Canadian patent, many different carbon blacks have been utilized to render a resin particle black for use as a xerographic toner. Typical examples which utilize a particularly low bulk conductivity carbon black are U.S. Pat. Nos. 3,954,640 to Lu et al and 3,890,240 to Hochberg.

Multilayer particles for use in the photoelectrophoretic imaging process are disclosed in U.S. Pat. No. 3,383,993 to Yeh. However, the multilayer particles are utilized in a complex scheme designed to achieve particular spectral response by means of light filtering through the layers. Also, U.S. Pat. No. 3,940,847 to Kaprelian discloses multilayer particles relating to light filtering in another migration imaging process. The multilayer particles of the prior art are difficult to produce and complex in operation. For example, previous multilayer particles having a core of colorant such as a dye depended upon the step of crushing the particle after image formation to disperse and utilize the dye.

Previously, certain limited types of carbon black have been utilized to prepare particles for the photoelectrophoretic imaging process. The selection has been based on their bulk conductivity and careful preparation such particles have been found to be useful. However, a broader range of materials is desired to be utilized in the preparation of photoelectrophoretic imaging particles wherein the colorant is non-photosensitive. Also, an improved means for attaching the electrically photosensitive material to the particle is desired.

SUMMARY OF THE INVENTION

It is an object of this invention to provide a photoelectrophoretic imaging process utilizing a suspension containing a novel imaging particle.

Another object of this invention is to provide methods whereby a novel particles are produced for utilization in the photoelectrophoretic imaging process.

Another object of this invention is to provide novel particles for use in the photoelectrophoretic imaging process.

In accordance with this invention, there is provided a double encapsulated electrically photosensitive particle wherein a colorant is formed by encapsulating the colorant in a first resin and then the first resin is encapsulated in a second resin which contains electrically photosensitive material. The electrically photosensitive material may be completely or partially embedded in the second resin. By constructing the particle in this manner, numerous materials heretofore not suitable or not considered for optimum operation of the photoelectrophoretic imaging process can now be utilized by means of the double encapsulation method.

In particular, colorant materials considered excessively electrically conductive can now be utilized. Another benefit obtained by the particles of this invention is the reduction in the amount of the electrically photosensitive material required. Formerly, the electrically photosensitive material was partially masked by the colorant if embedded too deeply and, if not embedded sufficiently, the photosensitive material would separate from the colorant.

Other advantages of the particles of this invention over the prior art include the opportunity to provide electrical isolation of the photosensitive material from the colorant. The choice of resin, as indicated below in the preferred embodiments, allow one to prevent dark charge injection of the photosensitive material by the colorant such as carbon black. Also, the outer second resin is chosen to be more stable in a suspension than is required of the inner, first resin. For example, polyethylene is less susceptable to agglomeration is a suspension than many other resins.

Several different methods can be utilized to provide the double encapsulated particles of this invention. In a preferred method, a colorant, such as carbon black is encapsulated in a first resin. Such procedures are well known in the art of xerography wherein toner particles are produced by combining carbon black and resin. Such methods as spray drying or comminution of cast resin containing carbon black are well known. The toner particles typically made and commercially available is suspended in a liquid medium which is a non-solvent for the resin of the toner. Also dispersed in the non-solvent is the electrically photosensitive material to be encapsulated in the second resin. The photosensitive material is usually finely grounded into extremely small particles. This second resin is then selected so as to be soluble in the liquid medium in which is dispersed the encapsulated colorant and electrically photosensitive material and is dissolved in this liquid.

With the toner particles and the electrically photosensitive particles uniformly dispersed in the liquid medium containing the dissolved second resin, a non-solvent for both the encapsulated colorant and the second resin is slowly added. The addition of the non-solvent causes the second resin to precipitate out of solution and form a surface layer over the toner particles which layer contains particles of the dispersed electrically photosensitive material. There is thus formed a double encapsulated particle wherein the electrically photosensitive material is firmly and uniformally attached to the exterior of the particle in a controlled amount. The colorant in the first resin provides the resultant color of the double encapsulated particle since the amount of the electrically photosensitive material is low and thus does not provide effect on the resultant color.

The effect of the color contribution by the photosensitive material is rendered less critical in some combinations. For example, a cyan driver such as phthalocyanine can enhance the blackness of a particle wherein the colorant is carbon black. Such combinations are known in the prior art such as is carbon typewriter ribbons.

While the above method is presently preferred, many other methods can be utilized to prepare the double encapsulated particle of this invention. Each encapsulation step can take place independently of the other or combined.

The encapsulation of the colorant material can take place by thermal or solvent means. Typical thermal means includes the heating of the resin to a viscosity which facilitates the distribution of colorant material therein. The resin containing the dispersed colorant is then cooled to a solid and subdivided to the desired particle size. Alternatively, the first resin can be dissolved in a solvent and while having the colorant also dispersed in the solvent, the solvent is removed as by evaporation in such manner as to produce particulate material. Spray drying techniques for this purpose are well known in the art.

Likewise, the second resin can be incorporated into the particle by thermal or solvent means. For example, encapsulated colorant particles and electrically photosensitive materials can be dispersed in a solvent for the second resin at a temperature at which the second resin is soluble. Upon cooling, the second resin precipitates around the encapsulated colorant particles and contains electrically photosensitive particles.

DETAILED DESCRIPTION OF THE INVENTION

Figure 1:
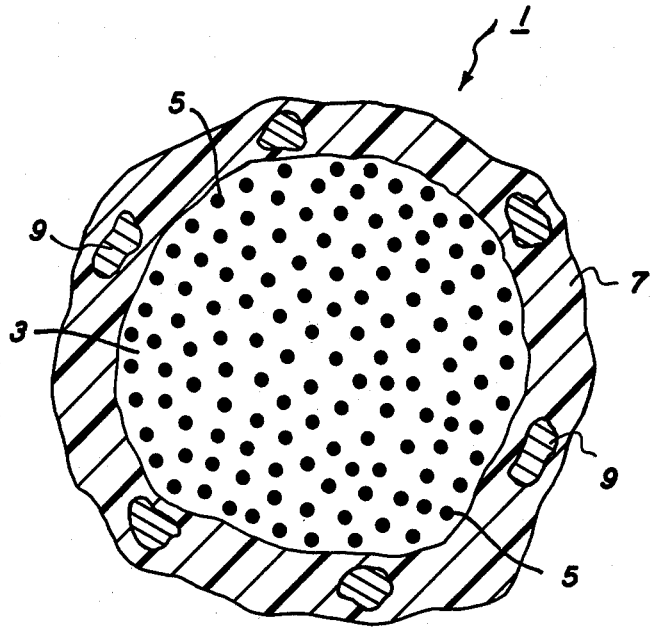
FIG. 1 shows, in magnified form, a cross-sectional view of a double encapsulated particle of this invention.

In the FIGURE there is shown, in greatly magnified form, the cross section of a double encapsulated particle of this invention. The particle, generally shown as 1, is formed of a first resin 3 into which there is dispersed small particles of colorant 5.

Resin 3 can be selected from a wide variety of resins since it will be encapsulated. Also, the first and second resins can actually be the same resin, usually having different molecular weights so as to provide a differentiation during the process of construction of the particle. Typical resins utilized as the first resin in the double encapsulated particle of this invention are those traditionally utilized in the production of toner particles for the xerographic process. Such synthetic polymers include vinyl-type polymers having characteristic monomeric structure; and made, for example from the following vinyl monomers: $>C{=}C<$ esters of saturated alcohols with mono and polybasic unsaturated acids such as alkyl acrylates and methacrylates, haloacrylates, diethyl maleate, and mixtures thereof; vinyl and vinylidens halides such as vinyl chloride, vinyl fluoethylene, chlorotrifluoroethylene and mixtures thereof; vinyl esters such as vinyl acetate, unsaturated aromatic compounds such as styrene and various alkyl styrenes, alpha-methyl styrene parachlorostyrene, parabromostyrene, 2,4-dichlorostyrene, vinyl naphthalene, paramethoxystyrene and mixtures thereof; unsaturated amides such as acrylamide, methacrylamide and mixtures thereof; unsaturated nitriles such as acrylonitrile, methacrylonitrile; haloacrylonitrile; phenylacrylonitrile, vinylidene cyanide, and mixtures thereof; N-substituted unsaturated amides such as N,N-dimethyl acrylamide, N-methyl acrylamide and mixtures thereof; conjugated butadienes such as butadiene, isoprne and mixtures thereof; unsaturated ethers such as divinyl ether, diallyl ether, vinyl alkyl ether and mixtures thereof; unsaturated ketones such as divinyl ketone, vinyl alkyl ketone and mixtures thereof; unsaturated aldehydes and acetals such as acrolein and its acetals, methacrolein and its acetals, and mixtures thereof; unsaturated heterocyclic compounds such as vinyl pyridine, vinyl furan, vinylcoumarone, N-vinyl carbazole, and mixtures thereof; unsaturated alicyclic compounds such as vinyl-cyclopentane, vinyl-cyclohexane and mixtures thereof; unsaturated thio compounds such as vinyl thio ethers; unsaturated hydrocarbons such as ethylene, propylene, coumarone, indene, terpene, polymerizable hydrocarbon fractions, isobutylene and mixtures thereof; allylcompounds such as allyl alcohol, allyl esters, diallyl phthalate, triallyicyanurate and mixtures thereof; as well as condensation polymers including polyesters, such as linear, unsaturated and alkyd types made, for example, by reacting a difunctional acid or anhydride such as phthalic, isophthalic, terphthalic, malic, maleic, citric, succinic, glutoric, adipic, tartaric, pimelic, suberic, azelaic, sebacic and camphoric with a polyol such as glycerine, ethylene glycol propylene glycol, sorbitol, mannitol, pentaerythritol, diethylene glycol and polyethylene glycol; polycarbonates such as bisphenol esters of carbonic acid; polyamides such as those made by reacting diamines with dibasic acids where the diamines contain from 2 to 10 carbon atoms and the acids contain from 2 to 18 carbon atoms; polyethers such as the epoxy type made, for example, by condensing epichlorohydrin with any one of bisphenol A, resorcinol, hydroquinone, ethylene glycol, glycerol, or other hydroxyl containing compounds; other polyethers made, for example, by reacting formaldehyde with difunctional glycols; polyurethanes prepared, for example, by reacting a diisocyanate such as toluene-2,4-diisocyanate methylene bis(4-phenylisocyanate), bitalyene diisocyanate, 1,5-naphthalene diisocyanate, and hexamethylene diisocyanate with a dihydroxy compound; phenol aldehyde resins made, for example, by condensing resorcinol, phenol or cresols with formaldehyde, furfural or hexamethylene tetramine; urea formaldehyde; melamine formaldehyde; polythioethers; polysulfonamides; alkyl, aryl and alkaryl silicones, etc.

Any suitable mixture, copolymer or terpolymer of the above materials may be used in the process of this invention. Polymers of the above types include polyvinyl butyral, copolymers of methacrylic acid with methymethacrylate, with acrylonitrile or with styrene, copolymer of vinyl acetate with maleic anhydride, copolymer of nitrostyrene with diethylmaleate, copolymers of styrene with acrylic and methacrylic acids and esters, etc.

Typical natural and modified natural resins include rosin, hydrogenated rosin, waxes, gums, fossil resins, protein resins such as zein, asphaltum and others.

The particle size of the encapsulated colorant containing the first resin is in the range of from sub micron to about 10 microns. Of course, other particle size ranges can be utilized depending upon the operating parameters of the imaging process in which it will be utilized.

Likewise, colorant 5 can include any suitable colorant since it will be doubly encapsulated. Typical colorants include carbon in the form of, for example, powdered lamp black carbon, chimney black or channel black, metallic oxides such as iron oxide, aluminum oxide, black dyes such as Nigrosine, Sudan black B, or black polymer such as polybutadiene-2-methyl-5-vinyl pyridine (90:10) supplied by Polyscience Inc.

Around resin 3 there is shown in FIG. 1 a layer of a second resin 7 containing electrically photosensitive particles 9. The second resin, 7, can be selected from the same or different resins as the first resin depending on the compatibility of such resin with the photoelectrophorectic imaging process in which it is to be utilized. For example, the same resin is selected for both the first and second resin by choosing different molecular weights for each. In this way, the first resin of a higher molecular weight will be soluble in a liquid medium at a different temperature range than the second resin of relatively lower molecular weight.

Since the second resin, 7, will be exposed to the imaging system utilized in the photoelectrophoretic process, one should select such resins as are known to be useful therein. Typical such resins include vinyl addition types such as vinyl acetate, acrylate types such as polymethacrylate, polystyrene, oxidized polyethylene, polysubstituted acrylate, copolymers such as styrene acrylate and polymethacrylate-styrene vinyltriethoxysilane. A particularly preferred resin is polyvinyl acetate because of its thermal stability and ease of fixing the image by thermal means. Other suitable resins as the second resin in the particle of this invention are disclosed in U.S. Pat. No. 3,384,488 referred to above and U.S. Pat. No. 3,357,989 to Byrne et al, both of which patents are hereby incorporated by reference.

The electrically photosensitive particles 9 of FIG. 1 can be selected from a wide variety of electrically photosensitive materials previously known in the art. Because it is easily available, and highly responsive to light under an electrical field, metal-free phthalocyanine is preferred. The metal-free phthalocyanine can be utilized in either the X, alpha or beta forms, however, the X form appears to give the best response. Typical electrically photosensitive particles are disclosed in U.S. Pat. No. 3,384,488 and U.S. Pat. No. 3,357,989, previously incorporated herein by reference.

In another embodiment, the second resin of the particles of this invention can act in the dual mode of encapsulating the first resin and also constitute the electrically photosensitive material. Thus, the need for particulate photosensitive material 9 is eliminated. Typical examples of photosensitive materials in polymer form as the second resin include organic donor-acceptor charge transfer complexes made up of donors such as phenoladelyde resins, phenoxies, expoxies polycarbonates, urethanes, styrene or the like complexed with electron acceptors such as 2,4,7-trinitio-9-fluorenone; 2,4,5,7-tetranitro-9-fluorenone; picnic acid; chloranil; etc. Other electron acceptors are known in the art, many of which are set forth in U.S. Pat. No. 3,383,993 to Yeh which is hereby incorporated by reference.

In the photoelectrophoretic imaging process, a liquid vehicle is utilized into which the electrically photosensitive particles 1, of this invention, are dispersed. Typically, the particles are dispersed in amounts of from about 8% to about 15% by weight into the electrically insulating liquid vehicle. While the imaging process is operable with any amount of particles 1 in the vehicle, images of lower density are obtained when the concentration of the particles is too low.

Obviously, the liquid vehicle utilized in the process is one which will not attack or dissolve resin 7 of particle 1. Typical, liquid vehicles include hydrocarbon types such as kerosene fractions. Typically available liquid vehicles include the Sohio series such Sohio Odorless Solvent 3440 available from the Standard Oil Company; Isopar series such Isopar G from the Exxon Corporation; Soltrol series such as Soltrol 170 from Phillips Petroleum Company. Other liquid vehicles include mineral oils, silicone oils and vegetable oils. Kerosene fractions are preferred because of cost and availability.

As is well known in the photoelectrophoretic imaging process electrical fields are usually in the range of from 40 volts per micron to about 200 volts per micron. Preferably, the electric field is in the range of from 60 volts per micron to about 100 volts per micron. In many instances, at least one of the surfaces bounding the imaging suspension is also an electrode. If exposure of the imaging suspension takes place while the suspension is subject to an electric field by a pair of electrodes, at least one should be at least partially transparent to the electromagnetic radiation utilized in the exposure step. However, the imaging suspension can be electrostatically charged and exposed while residing on one surface. Subsequently, the charged suspension is contacted by a second surface which is removed while the electrical field remains applied. In such instance, the second surface is either an electrode of the correct polarity and potential to supply the requisite electrical field across the suspension or is backed by an electrode for that purpose. Upon separation of the second electrode, the imaging suspension adheres to each surface in conformance with the exposure pattern.

During the imaging process of this invention, the double encapsulated particles of this invention are subjected to high compression due to the high field strength utilized. This compression may cause some conglomeration of the double encapsulated particles. The presence of such conglomerates causes a reduction in image quality. To prevent a conglomeration, a non-ionic surfactant may be added to the imaging suspension in amounts of from about 1% to about 5% by weight of the double encapsulated particles.

Typically, non-ionic surfactants include polyisobutylene, polydimethyl-siloxane and coplymers of dimethylsiloxane and vinyl acetate. Equivalent non-ionic surfactants can be employed. The addition of a surfactant also facilitates the pumping and coating of the imaging suspension so as to create a more uniform coating. Also, shelf life of the imaging suspension is greatly increased. A preferred surfactant is polyisobutylene with a molecular weight in the range of from about 10,000 to about 100,000. As in any imaging process, the images produced by the process of this invention may be more desirable on a surface other than that on which it is created. Thus, the image as created by the inventive process can be transferred to another suitable substrate. Typically, the image can be transferred electrostatically by means well known in the art. Adhesive receiving layers can also be employed.

The image is normally fixed by heat whereby the liquid vehicle is evaporated and the resin particle softened so as to adhere to the supporting substrate.

DESCRIPTION OF THE PREFERRED EMBODIMENTS

The following examples further specifically illustrate the present invention. The particles and percentages are by weight unless otherwise indicated. The examples below are intended to illustrate various preferred embodiments of the photoelectrophoretic imaging process and novel imaging particles of this invention.

EXAMPLE I

About 0.3 grams suspension polymerized copolymer comprising a 65/35% blend of styrene and n-butyl methacrylate is dissolved into 50 ml. of cyclohexane. About 0.2 gram of X form metal-free phthalocyanine having an average particle size of about 0.05 to about 0.1 micron is dispersed in the solution along with about 1.5 grams of xerographic toner which contains about 10% black Pearl L Carbon Black available from the Cabot Corporation and 90% propoxylated Bisphenol Fumarate available from ICI (U.S.). While the toner the phthalocyanine are uniformally dispersed in the cyclohexane solution, there is slowly added to the solution Sohio Odorless Solvent 3440 which results in the precipitation of the copolymer around the surface of the toner particles. The copolymer layer is found to contain particles of phthalocyanine rendering the resultant double encapsulated particle electrically photosensitive.

EXAMPLE II

About 0.3 grams vinylacetate-ethylene copolymer available from the E. I. DuPont DeNemours & Company, Inc. as Elvax resin 420 is dissolved in about 30 ml. of Sohio Odorless Solvent 3440 heated to 50° C. To this solution is added 1.5 grams of xerographic toner of Example I and 0.03 grams of X form metal-free phthalocyanine dispersed in Sohio Odorless Solvent 3440. The mixture allowed to cool with continuous stirring to room temperature to form the desired photosensitive ink. The particles are found to be coated with the vinylacetate-ethylene copolymer which contains particles of the X form metal-free phthalocyanine.

EXAMPLE III

A quantity of from 0.05–0.2 g of metal-free X form of phthalocyanine and Elvax 420 (0.05–1.5 g) in 50 ml Sohio Odorless Solvent 3440 is heated to 50° C. This mixture is added as a toner suspension in the same type liquid vehicle. The toner particle is fabricated by the following procedure: carbon black (0.05–0.15 g) and polyethylene (Union Carbide) (1.5 g) is heated and stirred in 50 ml Sohio until polyethylene is soluble. Upon cooling a toner dispersion of polyethylene and carbon blacks is formed in size from 1 to 10 microns. The first mixture at 50° C. is added to the second mixture and stirred to cool. Upon cooling encapsulation occurs to form a photosensitive particle.

EXAMPLE IV

A quantity of 0.5 g of polyvinylcarbazole trinitrofluorenone complex is dissolved in acetone (50 ml) and is mixed with 1.5 g of the xerographic tone of Example I. A non-solvent, such as methanol (100 ml) is added to precipitate the polyvinyl carbozole/trinitrofluorenone complex onto the outside of the toner particle. The solvent mixture is removed by filtration and the encapsulated particles are resuspended in Sohio Odorless Solvent to form the 3440 desired photosensitive ink.

EXAMPLE V

The particles prepared in accordance with Example II are dispersed in Sohio Odorless Solvent 3440 to provide an imaging suspension which is coated onto a one mil thick sheet of plastic substrate comprising polyethylene terephthalate available under the trade name Mylar from the E. I. DuPont DeNemours & Company, Inc. to a thickness of about 20 microns by means of wire-wound, draw-down rod. The surface of the suspension is negatively charged by means of corona discharge device in the dark to electrostatically adhere the double encapsulated particles to the substrate. The coating is then sandwiched between its substrate and a grounded electrode. With the electrodes in place the free surface of the substrate is charged to a positive potential to provide an electrical field across the coating of about 16 volts micron. With the above described electrical field applied across the imaging suspension an imagewise pattern of white light is projected through the substrate. With the voltage still applied, the electrodes are separated providing a photographically positive image on the Mylar substrate and a photographically negative image on the metal electrode. There is thus provided a pair of excellent quality images.

What is claimed is:

1. In an imaging process comprising providing first and second surfaces, sandwiching between said surfaces an imaging suspension comprising electrically photosensitive particles dispersed in an electrically insulating liquid vehicle, while subjecting said suspension to an electrical field, exposing said imaging suspension to a pattern of electromagnetic radiation to which said particles are sensitive and separating the surfaces whereby the exposed particles are retained on one of said surfaces and the unexposed particles are retained on the other surface, the improvement wherein said particles comprise double encapsulated particles comprising a colorant encapsulated in a first resin and second resin encapsulating said first resin, said second resin having embedded therein electrically photosensitive material, and said first resin capable of substantially preventing dark charge injection of said photosensitive material by said colorant.

2. The imaging process of claim 1 wherein the electrically photosensitive material is an organic pigment.

3. The imaging process of claim 2 wherein the electrically photosensitive material is present in the amount of from about 1% to or about 10% by weight of said second resin.

4. The imaging process of claim 2 wherein the electrically photosensitive material is metal-free phthalocyanine.

5. The process of claim 1 wherein the encapsulated colorant is a carbon black.

6. The process of claim 1 additionally containing the steps of transferring at least one said images from said surface to a receiving substrate and fixing said image on said substrate.

7. An electrically photosensitive double encapsulated particle comprising a colorant encapsulated in a first resin and second resin which encapsulates said first resin, said second resin having embedded therein electrically photosensitive material, and said first resin being capable of substantially preventing dark charge injection of said photosensitive material by said colorant.

8. The particle of claim 7 wherein said electrically photosensitive material in said second resin is in the range of from about 1% to about 10% by weight of said resin.

9. The particle of claim 7 wherein said electrically photosensitive material is an organic electrically photosensitive pigment.

10. The particle of claim 9 wherein said electrically photosensitive pigment is a metal-free phthalocyanine.

11. The particle of claim 9 wherein said phthalocyanine is in the X form.

* * * * *